US007175402B2

(12) United States Patent
Lee et al.

(10) Patent No.: US 7,175,402 B2
(45) Date of Patent: Feb. 13, 2007

(54) ECCENTRIC COUPLING DEVICE IN RADIAL COMPLIANCE SCROLL COMPRESSOR

(75) Inventors: Byeong-Chul Lee, Seoul (KR); Myung-Kyun Kiem, Incheon (KR); Byung-Kil Yoo, Seoul (KR); Dong-Won Yoo, Seoul (KR)

(73) Assignee: LG Electronics Inc., Seoul (KR)

( * ) Notice: Subject to any disclaimer, the term of this patent is extended or adjusted under 35 U.S.C. 154(b) by 126 days.

(21) Appl. No.: 10/872,391

(22) Filed: Jun. 22, 2004

(65) Prior Publication Data

US 2005/0129554 A1 Jun. 16, 2005

(30) Foreign Application Priority Data

Dec. 16, 2003 (KR) ..... 10-2003-0091949

(51) Int. Cl.
*F03C 2/00* (2006.01)
*F04C 18/00* (2006.01)

(52) U.S. Cl. ..... 418/55.5; 418/55.1; 418/57; 418/182

(58) Field of Classification Search ..... 418/55.1–55.6, 418/57, 182
See application file for complete search history.

(56) References Cited

U.S. PATENT DOCUMENTS

| | | | | |
|---|---|---|---|---|
| 4,580,956 | A | 4/1986 | Takahashi et al. | |
| 4,838,773 | A | 6/1989 | Noboru | |
| 5,104,302 | A * | 4/1992 | Richardson, Jr. | 418/55.5 |
| 5,199,862 | A | 4/1993 | Kondo et al. | |
| 5,378,129 | A * | 1/1995 | Dunaevsky et al. | 418/55.5 |
| 5,458,472 | A * | 10/1995 | Kobayashi et al. | 418/55.5 |
| 5,496,158 | A * | 3/1996 | Barito et al. | 418/55.5 |
| 5,531,578 | A | 7/1996 | Takemoto et al. | |
| 5,536,152 | A | 7/1996 | Kawahara et al. | |
| 5,779,461 | A * | 7/1998 | Iizuka et al. | 418/55.5 |
| 6,461,131 | B2 * | 10/2002 | Chang | 418/55.5 |
| 6,676,391 | B2 * | 1/2004 | Koo et al. | 418/55.5 |
| 2002/0001532 | A1 | 1/2002 | Chang | |

FOREIGN PATENT DOCUMENTS

| | | | |
|---|---|---|---|
| JP | 3-074588 | | 3/1991 |
| JP | 4-175486 | | 6/1992 |
| JP | 6-147145 | | 5/1994 |
| JP | 10220369 | A * | 8/1998 |
| JP | 2000073970 | A * | 3/2000 |
| JP | 2003-343454 | | 12/2003 |
| KR | 10-0183502 | | 12/1995 |
| KR | 10-0371171 | | 1/2002 |

OTHER PUBLICATIONS

English Language Abstract of KR 10-2002-0002874.
English Language Abstract of KR 10-0183502.
English Language Abstract of JP 2003-343454.
English Language Abstract of JP 4-175486.
English Language Abstract of JP 3-074588.
English Language Abstract of JP 6-147145.

* cited by examiner

*Primary Examiner*—Theresa Trieu
(74) *Attorney, Agent, or Firm*—Greenblum & Bernstein P.L.C.

(57) ABSTRACT

An eccentric coupling device in a radial compliance scroll compressor includes a crank pin that is eccentrically arranged at an upper end of a crankshaft and provided with a vertically-extending flat surface at one side thereof. A bush is provided with a crank pin hole, overlapped by a stopper hole, for receiving the crank pin. A stopper is fitted in the stopper hole such that the stopper radially protrudes into the crank pin hole toward the flat surface to selectively come into contact with the flat surface in accordance with a rotation of the bush. An elevating preventing device is adapted to elastically support the bush, while connecting the stopper and the crank pin via a spring wire, preventing an elevation of the bush.

11 Claims, 6 Drawing Sheets

PRIOR ART

ECCENTRIC COUPLING DEVICE IN RADIAL COMPLIANCE SCROLL COMPRESSOR

BACKGROUND OF THE INVENTION

1. Field of the Invention

The present invention relates to a scroll compressor, and more particularly to an eccentric coupling device in a radial compliance scroll compressor, which is capable of elastically supporting an eccentric bush included in the scroll compressor to prevent the eccentric bush from rising axially during operation of the scroll compressor.

2. Description of the Related Art

Generally, a scroll compressor includes upper and lower scrolls respectively provided with involute-shaped wraps engaged with each other. One of the scrolls performs an orbiting motion with respect to the other scroll to reduce the volume of spaces defined between the scrolls, thereby compressing gas confined in the spaces.

As such a conventional compressor, a radial compliance scroll compressor is known. In such a radial compliance scroll compressor, an orbiting scroll thereof is backwardly moved when liquid refrigerant, oil or foreign matter is introduced into compression chambers defined between the orbiting scroll and the other scroll, that is, a fixed scroll, thereby abnormally increasing the gas pressure in the compression chambers. In accordance with the backward movement of the orbiting scroll, it is possible to prevent the wraps of the scrolls from being damaged due to the abnormally increased gas pressure.

FIG. 1 is a sectional view illustrating the entire configuration of a conventional radial compliance scroll compressor.

As shown in FIG. 1, the conventional radial compliance scroll compressor includes a shell 1, and main and sub frames 2 and 3 respectively arranged in the shell 1 at upper and lower portions of the shell 1. A stator 4, which has a hollow structure, is interposed between the main and sub frames 2 and 3 within the shell 1.

A rotor 5 is arranged inside the stator 4 such that it rotates when current flows through the stator 4. A vertical crankshaft 6 extends axially through a central portion of the rotor 5 while being fixed to the rotor 5 so that it is rotated along with the rotor 5. The crankshaft 6 has upper and lower ends protruded beyond the rotor 5, and rotatably fitted in the main and sub frames 2 and 3, respectively. Thus, the crankshaft 6 is rotatably supported by the main and sub frames 2 and 3.

An orbiting scroll 7 is mounted to an upper surface of the main frame 2 in the shell 1. The orbiting scroll 7 is coupled, at a lower portion thereof, with the upper end of the crankshaft 6, which is protruded through the main frame 2, so that it performs an orbiting motion in accordance with rotation of the crankshaft 6. The orbiting scroll 7 is provided, at an upper portion thereof, with an orbiting wrap 7*a* having an involute shape. The orbiting wrap 7*a* extends upwardly from an upper surface of the orbiting scroll 7. A fixed scroll 8 is arranged on the orbiting scroll 7 in the shell 1 while being fixed to the shell 1. The fixed scroll 8 is provided, at a lower portion thereof, with a fixed wrap 8*a* adapted to be engaged with the orbiting wrap 7*a* of the orbiting scroll 7 such that compression chambers 22 are defined between the wraps 7*a* and 8*a*.

With this configuration, when the orbiting scroll 7 performs an orbiting motion in accordance with rotation of the crankshaft 6, gaseous refrigerant is introduced into the compression chambers 22 in a sequential fashion, so that it is compressed.

For the orbiting motion thereof, the orbiting scroll 7 is eccentrically coupled to the crankshaft 6. For this eccentric coupling, the crankshaft 6 is provided with a crank pin 10 upwardly protruded from the upper end of the crankshaft 6 at a position radially spaced apart from the center of the upper end of the crankshaft 6 by a certain distance. Also, the orbiting scroll 7 is provided, at the lower portion thereof, with a boss 7*b* centrally protruded from a lower surface of the orbiting scroll 7.

A bearing 11 is forcibly fitted in the boss 7*b*. Also, an eccentric bush 12 is rotatably fitted around the crank pin 10. The crank pin 10 of the crankshaft 6 is rotatably received in the boss 7*b* of the orbiting scroll 7 via the bearing 11 and eccentric bush 12, so that the orbiting scroll 7 is eccentrically coupled to the crankshaft 6.

As a rotation preventing mechanism for the orbiting scroll 7, an Oldham ring 9 is arranged between the main frame 2 and the orbiting scroll 7. An oil passage 6*a* extends vertically throughout the crankshaft 6. Upper and lower balance weight members are provided at upper and lower surfaces of the rotor 5, respectively, in order to prevent a rotation unbalance of the crankshaft 6 caused by the crank pin 10.

In FIG. 1, reference numerals 15 and 16 designate suction and discharge pipes, respectively, reference numerals 17 and 18 designate a discharge port and a discharge chamber, respectively, reference numeral 19 designates a check valve, reference numeral 20 designates oil, and reference numeral 21 designates an oil propeller.

When current flows through the stator 4, the rotor 5 is rotated inside the stator 4, thereby causing the crankshaft 6 to rotate. In accordance with the rotation of the crankshaft 6, the orbiting scroll 7 coupled to the crank pin 10 of the crankshaft 6 performs an orbiting motion with an orbiting radius defined between the center of the crankshaft 6 and the center of the orbiting scroll 7.

In accordance with a continued orbiting motion of the orbiting scroll 7, the compression chambers 22, which are defined between the orbiting wrap 7*a* and the fixed wrap 8*a*, are gradually reduced in volume, so that gaseous refrigerant sucked into each compression chamber 22 via the suction pipe 15 is compressed to high pressure. The compressed high-pressure gaseous refrigerant is subsequently discharged into the discharge chamber 18 via the discharge port 17. The compressed high-pressure gaseous refrigerant is then outwardly discharged from the discharge chamber 18 via the discharge pipe 16.

Meanwhile, when an abnormal increase in pressure occurs in the compression chambers 22 due to introduction of liquid refrigerant, oil or foreign matter into the compression chambers 22, the orbiting scroll 7 is radially shifted such that the orbiting wrap 7*a* is moved away from the fixed wrap 8*a*, due to the abnormally increased pressure. As a result, it is possible to prevent the wraps 7*a* and 8*a* from being damaged by the abnormally increased pressure.

In the radial compliance scroll compressor having the above mentioned configuration, the eccentric bush 12 is coupled to the crank pin 10 in the above mentioned manner, in order to vary the orbiting radius of the orbiting scroll 7. Also, the eccentric bush 12 generates a centrifugal force corresponding to an eccentricity thereof, that is, the distance between the center of the crank pin 10 and the center of the eccentric bush 12, during the orbiting motion of the orbiting scroll 7. By virtue of this centrifugal force, the eccentric bush 12 can perform a sealing function for the compression chambers 22.

FIG. 2 is an exploded perspective view illustrating a structure of the conventional eccentric bush.

As shown in FIG. 2, the eccentric bush 12 has a crank pin hole 12*b* so that it is rotatably fitted around the crank pin 10. When an abnormal increase in pressure occurs in the compression chambers 22, the eccentric bush 12 is rotated such that the orbiting scroll 7 is radially shifted to cause the orbiting wrap 7*a* to be moved away from the fixed wrap 8*a*.

In order to limit the rotation of the eccentric bush 12 to a predetermined angle, the crank pin 10 has a cutout having a D-shaped cross-section, and thus, a cut surface 10*a*, at one side thereof. The eccentric bush 12 also has a stopper hole 12*a* at one side of the crank pin hole 12*b*.

A cylindrical stopper 23 is fitted in the stopper hole 12*a*. The stopper hole 12*a* is arranged such that it overlaps with the crank pin hole 12*b*, so that the cylindrical stopper 23 fitted in the stopper hole 12*a* is radially protruded into the crank pin hole 12*b*.

FIGS. 3*a* and 3*b* are cross-sectional views respectively illustrating different operation states of the eccentric bush shown in FIG. 2. FIG. 3*a* shows the state in which the eccentric bush is positioned at a normal position, whereas FIG. 3*b* shows the state in which the eccentric bush is positioned at a rotated position.

At the normal position of the eccentric bush 12, the stopper 23 is spaced apart from the cut surface 10*a*, as shown in FIG. 3*a*.

When the eccentric bush 12 is rotated, as indicated by an arrow in FIG. 3*b*, the stopper 23 is rotated, along with the eccentric bush 12, so that it comes into contact with the cut surface 10*a*. Thus, the rotation of the eccentric bush 12 is limited to a certain range.

Such a rotation of the eccentric bush 12 occurs when the gas pressure in the compression chambers 22 is abnormally increased, or at an initial operation stage of the scroll compressor, at which the centrifugal force of the orbiting scroll 7 is smaller than the gas pressure in the compression chambers 22.

The eccentric bush 12 is maintained at the rotated position until the operation state of the scroll compressor reaches a normal operation state. As a result, the refrigerant gas contained in the compression chambers 22 is continuously leaked from the compression chambers 22 through gaps defined between the wraps 7*a* and 8*a* until the eccentric bush 12 returns from the rotated position thereof to the normal position thereof.

Oil is fed to the upper end of the eccentric bush 12 through the oil passage 6*a* of the crankshaft 6, and then dispersed from the upper end of the eccentric bush 12 to perform a function of lubricating contact portions of the bearing 11 and eccentric bush 12. However, there may be a difference between the amounts of oil respectively supplied to the upper and lower portions of the eccentric bush 12.

Such an oil supply amount difference may generate friction between the bearing 11 and the eccentric bush 12 at the lower portion of the eccentric bush 12. Such friction may cause the eccentric bush 12 to rise axially.

Also, abnormal behavior of the eccentric bush 12 may be caused by friction generated between the crank pin 10 and the eccentric bush 12 as the eccentric bush 12 is repeatedly rotated in forward and backward directions during operation of the scroll compressor. For example, the eccentric bush 12 may be repeatedly moved in upward and downward directions without being maintained at a fixed vertical position.

This will be described in more detail. The eccentric bush 12 has an inner peripheral surface roughly machined as compared to an outer peripheral surface thereof to be in slidable contact with the bearing 11. Due to the roughness of the inner peripheral surface of the eccentric bush 12, increased friction is generated between the eccentric bush 12 and the crank pin 10. For this reason, the eccentric bush 12 exhibits abnormal behavior.

In the above mentioned conventional eccentric bush structure, the eccentric bush 12 thereof, which has been rotated at an initial operation stage of the scroll compressor, is returned when the operation state of the scroll compressor reaches a normal operation state at which the eccentric bush 12 generates a centrifugal force larger than the gas pressure in the compression chambers 22.

For this reason, a lot of time is taken to eliminate abnormal behavior of the eccentric bush 12. Furthermore, leakage of refrigerant gas occurs continuously during a period of time, for which the eccentric bush 12 carries out abnormal behavior. As a result, re-compression of refrigerant gas is required, so that the compression efficiency and performance of the scroll compressor are degraded.

When the eccentric bush 12 is axially elevated due to various causes including a self-moment thereof, the contact area between the eccentric bush 12 and the crank pin 10 is reduced by the elevation length of the eccentric bush 12.

For this reason, a tilting phenomenon may occur. That is, the eccentric bush 12 may be upwardly moved in a state of being inclined to one side thereof. Such a tilting phenomenon causes an increase in the frictional force generated between the eccentric bush 12 and the bearing 11. As a result, the mechanism of the scroll compressor may be damaged. Furthermore, the performance of the scroll compressor may be degraded.

SUMMARY OF THE INVENTION

The present invention has been made in view of the above mentioned problems, and an object of the invention is to provide an eccentric coupling device in a radial compliance scroll compressor, which is capable of applying an elastic force to a bush in one direction when the bush is rotated in the other direction due to a gas pressure in compression chambers greater than a centrifugal force of an orbiting scroll serving to perform an orbiting motion for compressing gas contained in the compression chambers, while preventing the bush from rising axially during the compression operation of the scroll compressor.

Another object of the invention is to provide an eccentric coupling device in a scroll compressor which has a simple construction while being capable of achieving the above object.

Another object of the invention is to provide an eccentric coupling device in a scroll compressor which is capable of elastically supporting a bush such that the bush is maintained at a normal position thereof, using a spring wire, while minimizing friction generated between an end of the spring wire and an inner peripheral surface of the bush contacting the end of the spring wire.

In accordance with a first aspect, the present invention provides an eccentric coupling device in a radial compliance scroll compressor comprising: a crank pin eccentrically arranged at an upper end of a crankshaft included in the scroll compressor, and provided with a vertically-extending cut surface at one side thereof; a bush provided with a crank pin hole adapted to receive the crank pin, and a stopper hole provided at the bush at one side of the crank pin hole such that the stopper hole overlaps with the crank pin hole; a stopper fitted in the stopper hole such that the stopper is radially protruded into the crank pin hole toward the cut surface to selectively come into contact with the cut surface in accordance with a rotation of the bush; and elevation preventing device adapted to elastically support the bush, while connecting the stopper and the crank pin, thereby preventing an elevation of the bush.

In the eccentric coupling device according to the first aspect of the present invention, the stopper and crank pin is elastically connected by the elevation preventing device. Thus, the stopper is elastically supported to prevent an axial elevation of the bush.

In the eccentric coupling device according to the first aspect of the present invention, the elevation preventing device may comprise a spring wire fixedly mounted, at one end thereof, to the crank pin while being engaged with a peripheral surface of the stopper. The spring wire elastically supports the stopper. In accordance with this configuration, it is possible to elastically support the stopper with a simple construction, thereby preventing an axial elevation of the bush.

In the eccentric coupling device according to the first aspect of the present invention, the bush may further comprise a spring contact recess provided around the stopper hole at an upper end of the stopper hole such that the other end of the spring wire is in contact with an inner peripheral surface of the spring contact recess. The spring wire is pressed against the inner peripheral surface of the spring contact recess when the bush is rotated, so that the spring wire is bent. In accordance with this configuration, it is possible to increase an elastic force of the spring wire to elastically support the bush.

In the eccentric coupling device according to the first aspect of the present invention, the stopper may further comprise an engagement groove formed around the peripheral surface of the stopper, and adapted to receive a portion of the spring wire such that the spring wire is slidably engaged with the stopper. In accordance with this configuration, it is possible to elastically support the stopper when the stopper is rotated in accordance with a rotation of the bush.

In the eccentric coupling device according to the first aspect of the present invention, the elevation preventing device may further comprise a curling provided at the other end of the spring wire. The curling may be formed by bending the other end of the spring wire. In accordance with this configuration, it is possible to minimize friction generated between the other end of the spring wire and the inner peripheral surface of the bush contacting the other end of the spring wire.

In the eccentric coupling device according to the first aspect of the present invention, the crank pin may further comprise a spring mounting hole provided at the crank pin, and adapted to receive the one end of the spring wire, thereby firmly mounting the spring wire. In accordance with this configuration, it is possible to easily fix the spring wire to the crank pin.

In accordance with a second aspect, the present invention provides an eccentric coupling device in a radial compliance scroll compressor comprising: a crank pin eccentrically arranged at an upper end of a crankshaft included in the scroll compressor, and provided with a vertically-extending cut surface at one side thereof, the crank pin having a vertically-extending cut surface at one side thereof; a bush provided with a crank pin hole adapted to receive the crank pin, and a stopper hole provided at the bush at one side of the crank pin hole such that the stopper hole overlaps with the crank pin hole; a stopper fitted in the stopper hole such that the stopper is radially protruded into the crank pin hole toward the cut surface to selectively come into contact with the cut surface in accordance with a rotation of the bush; and backward rotation suppressing and recovering device adapted to suppress a backward rotation of the bush, while elastically recovering the bush when the backward rotation of the bush has occurred.

In the eccentric coupling device according to the second aspect of the present invention, the backward rotation suppressing and recovering device suppresses a backward rotation of the stopper caused by a backward rotation of the bush, and recovers the stopper when the stopper has been backwardly rotated. Accordingly, it is possible not only to suppress the bush operatively connected with the stopper from being backwardly rotated, but also to recover the bush when the bush has been backwardly rotated.

In the eccentric coupling device according to the second aspect of the present invention, the backward rotation suppressing and recovering device may comprise a spring wire fixedly mounted, at one end thereof, to the crank pin while being engaged with a peripheral surface of the stopper. The spring wire elastically supports the stopper. In accordance with this configuration, the spring wire is elastically bent in accordance with rotation of the stopper, thereby generating an elastic resilience. By virtue of the elastic resilience, it is possible to suppress a backward rotation of the bush, and to recover the bush when the bush has been backwardly rotated.

In the eccentric coupling device according to the second aspect of the present invention, the bush may further comprise a spring contact recess provided around the stopper hole at an upper end of the stopper hole such that the other end of the spring wire is in contact with an inner peripheral surface of the spring contact recess. The spring wire is pressed against the inner peripheral surface of the spring contact recess when the bush is rotated, so that the spring wire is bent. In accordance with this configuration, it is possible to increase an elastic force of the spring wire to elastically support and recover the bush.

In the eccentric coupling device according to the second aspect of the present invention, the stopper may further comprise an engagement groove formed around the peripheral surface of the stopper, and adapted to receive a portion of the spring wire such that the spring wire is slidably engaged with the stopper. In accordance with this configuration, it is possible to elastically support and recover the stopper when the stopper is rotated in accordance with a rotation of the bush.

In the eccentric coupling device according to the second aspect of the present invention, the backward rotation suppressing and recovering device may further comprise a curling provided at the other end of the spring wire. The curling may be formed by bending the other end of the spring wire. In accordance with this configuration, it is possible to minimize friction generated between the other end of the spring wire and the inner peripheral surface of the bush contacting the other end of the spring wire.

In the eccentric coupling device according to the second aspect of the present invention, the crank pinmay further comprise a spring mounting hole provided at the crank pin, and adapted to receive the one end of the spring wire, thereby firmly mounting the spring wire. In accordance with this configuration, it is possible to easily fix the spring wire to the crank pin.

BRIEF DESCRIPTION OF THE DRAWINGS

The above objects, and other features and advantages of the present invention will become more apparent after reading the following detailed description when taken in conjunction with the drawings, in which.

DESCRIPTION OF THE PREFERRED EMBODIMENTS

Now, embodiments of an eccentric coupling device in a radial compliance scroll compressor according to the present invention will be described with reference to the annexed drawings.

Figure 1:
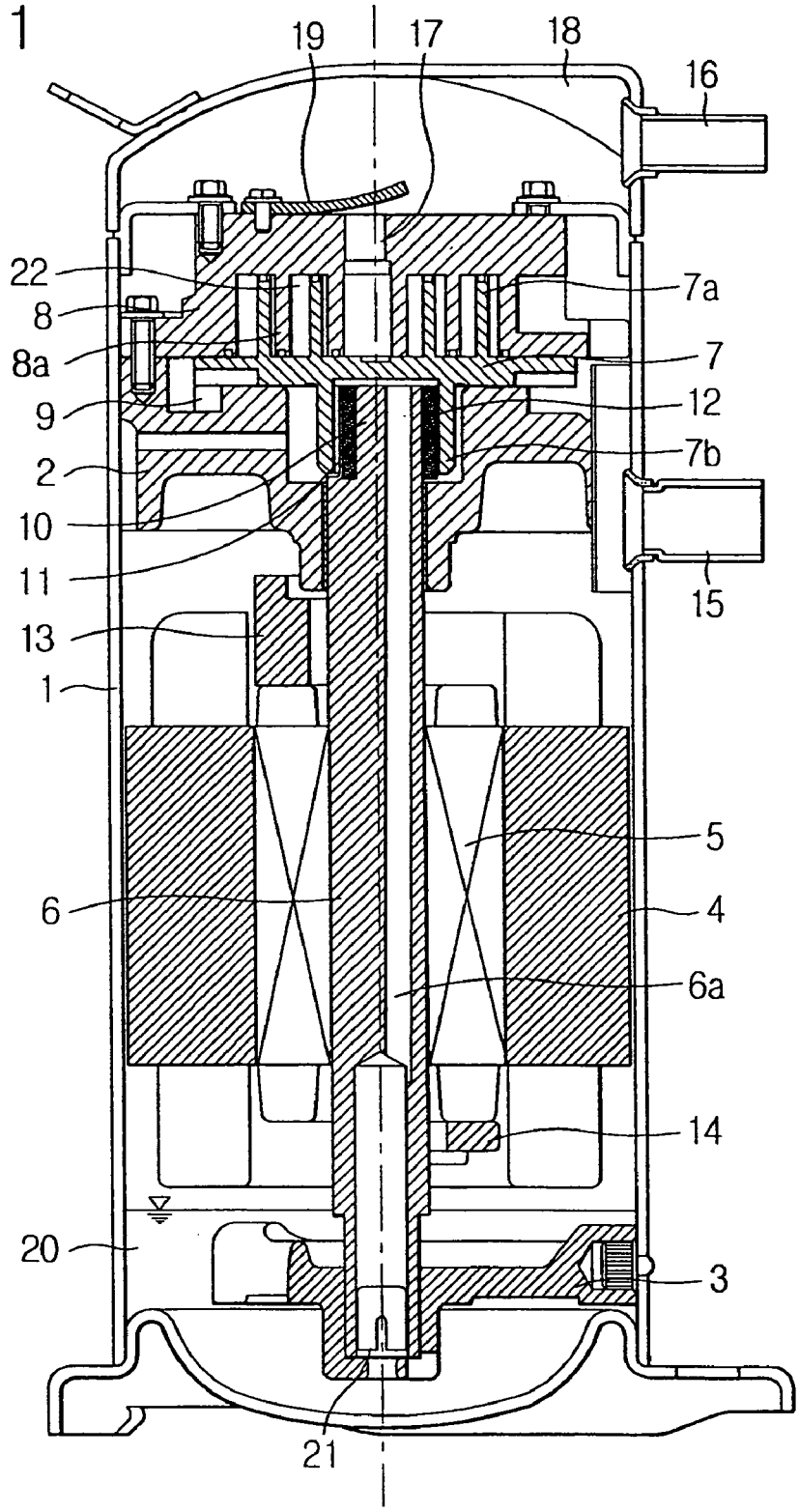
FIG. 1 is a sectional view illustrating the entire configuration of a conventional radial compliance scroll compressor.
Figure 2:
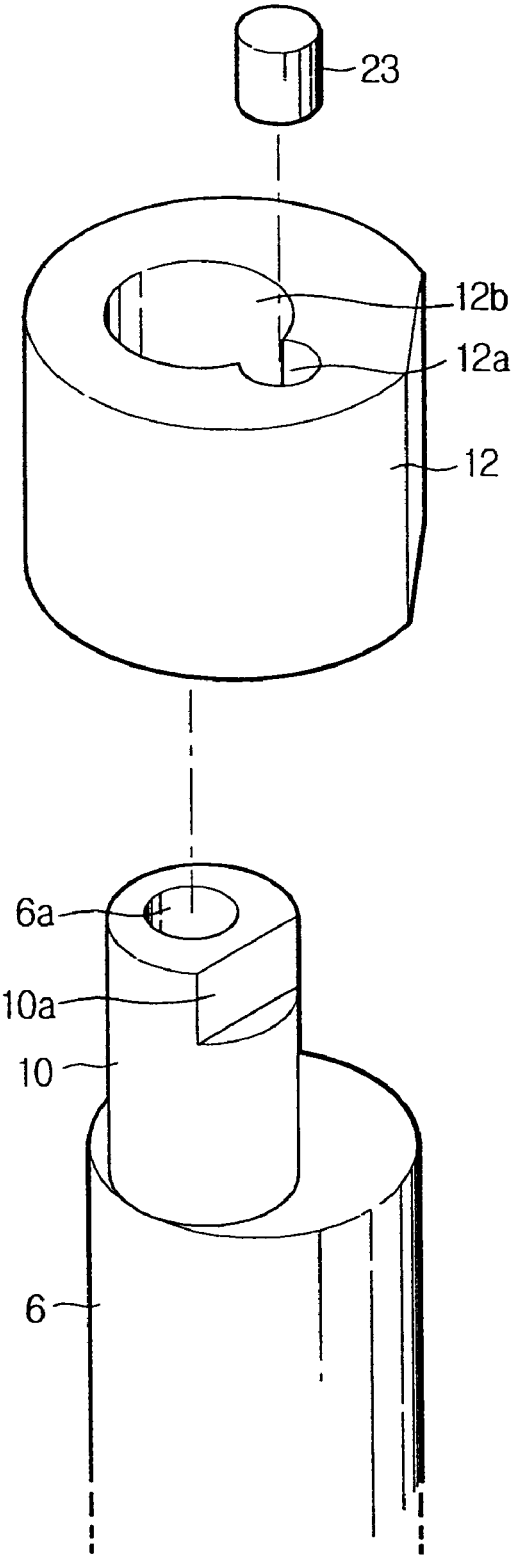
Fig.2 PRIOR ART
FIG. 2 is an exploded perspective view illustrating a structure of a conventional eccentric coupling device.
Figure 3A:
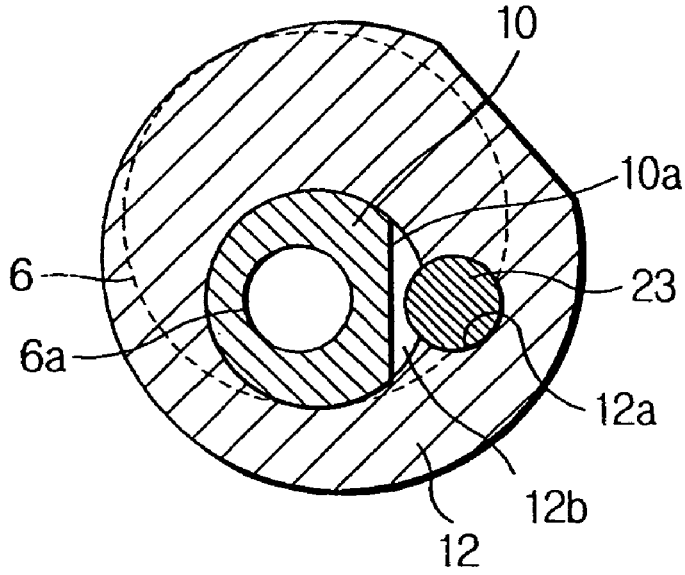
Fig.3a PRIOR ART
FIG. 3*a* is a cross-sectional view illustrating the state in which an eccentric bush is positioned at a normal position.
Figure 3B:
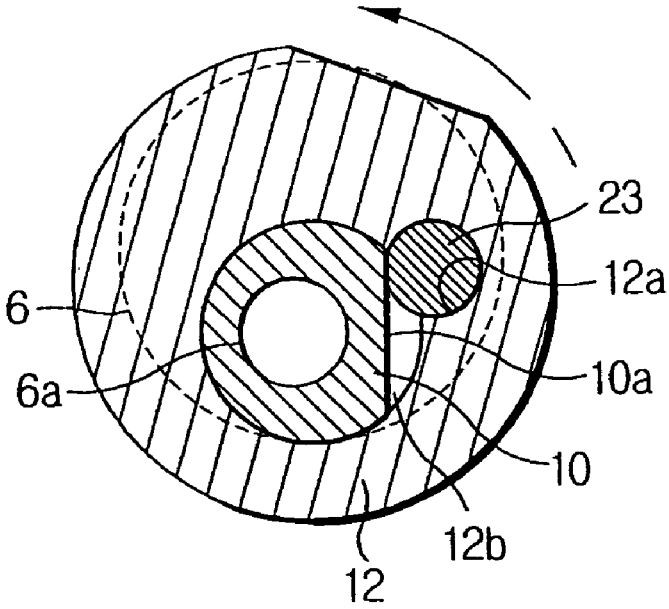
Fig.3b PRIOR ART
FIG. 3*b* is a cross-sectional view illustrating the state in which the eccentric bush is positioned at a rotated position.
Figure 4:
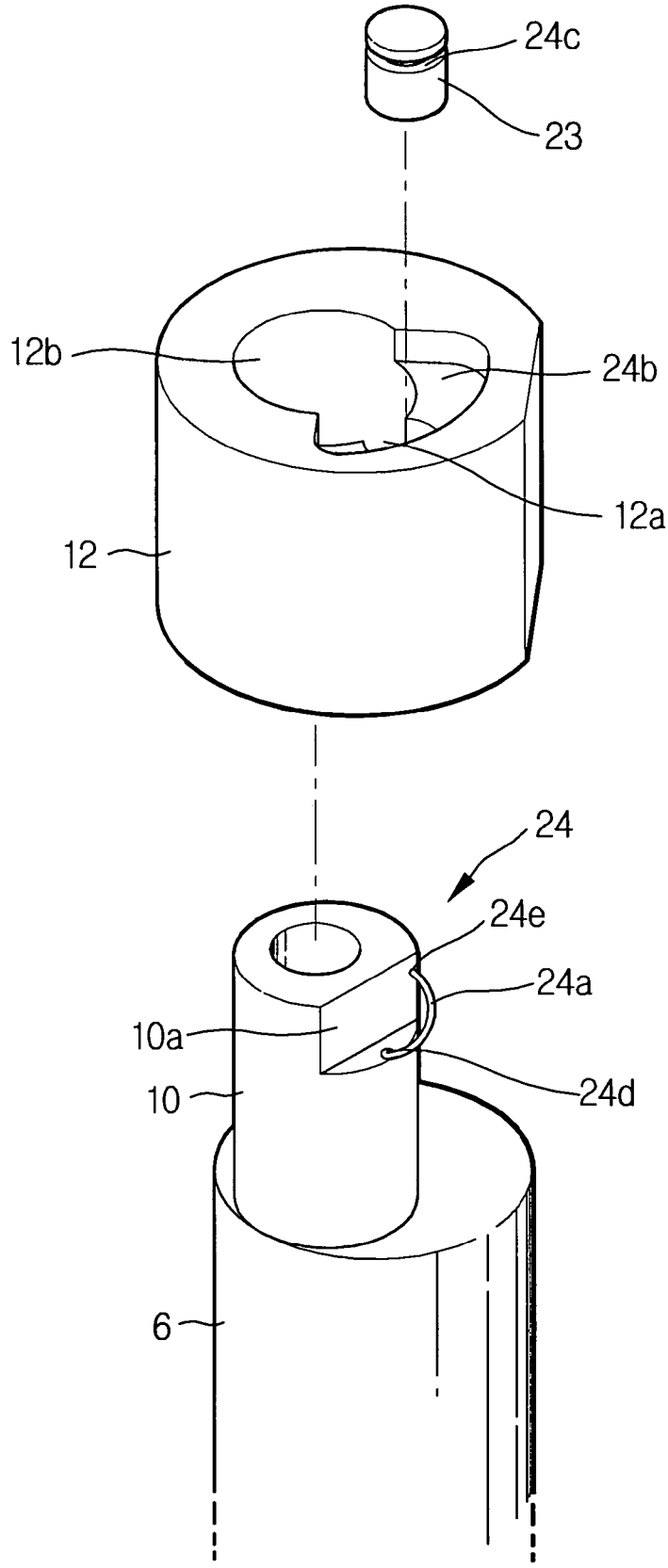
FIG. 4 is an exploded perspective view illustrating an eccentric coupling device according to an embodiment of the present invention.

FIG. 4 is an exploded perspective view illustrating an eccentric coupling device according to an embodiment of the present invention. The eccentric coupling device may be applied to the radial compliance scroll compressor shown in FIG. 1. In order to simplify the description thereof, the eccentric coupling device will be described in conjunction with the case in which it is applied to the radial compliance scroll compressor shown in FIG. 1. In FIG. 4, elements respectively corresponding to those in FIGS. 1 and 2 will be designated by the same reference numerals.

As shown in FIG. 4, the eccentric coupling device includes a crank pin 10 provided at an upper end of a crankshaft 6 such that it is eccentrically arranged with respect to the crankshaft 6, an eccentric bush 12 rotatably fitted around the crank pin 10, a stopper 23 fitted in the eccentric bush 12, and an elevation preventing means 24 adapted to elastically support the stopper 23, thereby preventing an elevation of the eccentric bush 12.

The eccentric bush 12 is provided with a crank pin hole 12*b* extending vertically throughout the eccentric bush 12, and a stopper hole 12*a* extending vertically into the eccentric bush 12. The crank pin hole 12*b* receives the crank pin 10 such that the crank pin 10 is rotatable therein. The crank pin 10 is provided, at one side thereof, with a cutout formed at an upper portion of the crank pin 10 while having a D-shaped cross-section, and thus, a cut surface 10*a*.

The stopper 23 is fitted in the stopper hole 12*a*. The stopper hole 12*a* is arranged such that it overlaps with the crank pin hole 12*b*, so that the cylindrical stopper 23 fitted in the stopper hole 12*a* is radially protruded into the crank pin hole 12*b*. In accordance with this arrangement, the stopper 23 can come into contact with the cut surface 10*a* in accordance with rotation of the crank pin 10. Accordingly, rotation of the eccentric bush 12 is limited to a certain range.

The elevation preventing means (or elevation preventer) 24 comprises a spring wire 24*a* mounted, at one end thereof, to the crank pin 10, and adapted to elastically connect the stopper 23 to the crank pin 10, a spring contact recess 24*b* provided around the stopper hole 12*a* at an upper end of the stopper hole 12*a*, an engagement groove 24*c* formed around a peripheral surface of the stopper 23, a curling 24*d* formed at the other end of the spring wire 24*a*, and a spring mounting hole 24*e* provided at the crank pin 10 to receive the end of the spring wire 24*a* opposite to the curling 24*d*, thereby firmly mounting the spring wire 24*a*.

With this configuration, the elevation preventing means 24 elastically connects the stopper 23 and crank pin 10, and thus, prevents an elevation of the stopper 23, thereby preventing an elevation of the eccentric bush 12.

The spring wire 24*a* may be made of a steel wire having an elasticity. As described above, the spring wire 24*a* is mounted, at one end thereof, to the crank pin 10, while being engaged, at the other end thereof, with the peripheral surface of the stopper 23. Thus, the spring wire 24*a* elastically supports the stopper 23, thereby preventing an elevation of the stopper 23, and thus, an elevation of the eccentric bush 12, in which the stopper 23 is fitted.

Since the eccentric bush 12 is prevented from being elevated, by the spring wire 21*a*, it is possible to eliminate a tilting phenomenon of the eccentric bush 12, thereby reducing friction generated between the eccentric bush 12 and a bearing fitted around the eccentric bush 12. As a result, it is possible to prevent the eccentric bush 12 from being damaged.

The spring contact recess 24*b* is in contact with the curling 24*d* of the spring wire 24*a* at a peripheral surface thereof. Accordingly, the spring wire 24*a* is bent when the eccentric bush 12 is rotated with respect to the crank pin 10, so that the elastic force of the spring wire 24*a* to support the eccentric bush 12 is increased. Thus, it is possible to more positively prevent an elevation of the eccentric bush 12.

The engagement groove 24*c*, which is formed around the peripheral surface of the stopper 23, receives a portion of the spring wire 24*a* while allowing the spring wire 24*a* to be slidable therealong. Accordingly, the spring wire 24*a* can elastically support the stopper 23 while allowing the stopper 23 to be freely rotatable when the eccentric bush 12 rotates.

The curling 24*d* is formed by bending the end of the spring wire 24*a* spaced away from the crank pin 10, so that it provides a round end surface. Accordingly, it is possible to minimize friction generated between the end of the spring wire 24*a* and the inner peripheral surface of the eccentric bush 12, thereby preventing the eccentric bush 12 from being damaged by the spring wire 24*a*.

The spring mounting hole 24*e* receives the end of the spring wire 24*a* opposite to the curling 24*d*, thereby firmly mounting the spring wire 24*a* to the crank pin 10. Thus, the spring wire 24*a* can be easily fixed to the crank pin 10.

The spring contact recess 24*b*, which is arranged around the stopper hole 12*a* at the upper end of the stopper hole 12*a*, has an arc shape having a diameter larger than that of the stopper hole 12*a*. The spring wire 24*a* is received in the spring contact recess 24*b* such that the curling 24*d* thereof is in contact with the inner peripheral surface of the spring contact recess 24*b*.

The spring wire 24*a* extends along a portion of the peripheral surface of the stopper 23 opposite to the crank pin 10. It is necessary to prevent the spring wire 24*a* from being moved along with the eccentric bush 12 when the eccentric bush 12 is rotated. To this end, the spring wire 24*a* is fixed to the crank pin 10 at one end thereof, while being in contact with the inner peripheral surface of the spring contact recess 24*b* at the other end thereof.

When the eccentric bush 12 is rotated with respect to the crank pin 10, friction is generated between the other end of the spring wire 24*a* and the inner peripheral surface of the spring contact recess 24*b*. In accordance with the illustrated embodiment of the present invention, the friction is minimized because the curling 24*d* is provided at the other end of the spring wire 24*a*. As described above, the curling 24*d* is formed by inwardly bending or folding the other end of the spring wire 24*a*.

The spring mounting hole 24*e* is formed at the cut surface 10*a* of the crank pin 10 near the periphery of the crank pin 10 such that it receives one end of the spring wire 24*a*. Accordingly, the spring wire 24*a* is firmly mounted, at one end thereof, to the crank pin 10 without interfering with the eccentric bush 12.

The engagement groove 24*c*, which is formed around the peripheral surface of the stopper 23 to have an annular shape, receives a portion of the spring wire 24*a*, thereby preventing an axial elevation of the stopper 23.

Figure 5:
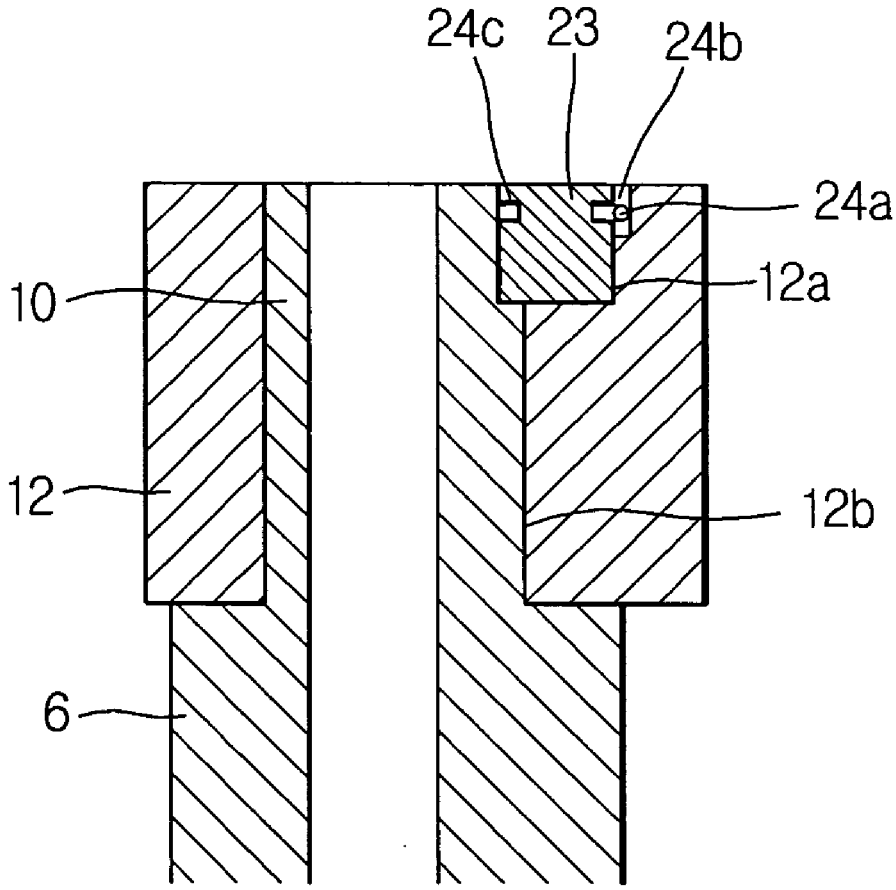
FIG. 5 is a sectional view illustrating an assembled state of the eccentric coupling device shown in FIG. 4.

FIG. 5 is a sectional view illustrating an assembled state of the eccentric coupling device shown in FIG. 4.

As shown in FIG. 5, in the eccentric coupling device, the stopper 23 is fitted in the stopper hole 12*a* of the eccentric bush 12. The crank pin is rotatably fitted in the crank pin hole 12*b* of the eccentric bush 12.

The spring wire 24*a* is received in the spring contact recess 24*b* formed over the stopper hole 12*a* such that it is arranged outside the stopper 23. The spring wire 24*a* is mounted, at one end thereof, to the crank pin 10 while being in contact with the inner peripheral surface of the spring contact recess 24*b* at the other end thereof.

Since the engagement groove 24*c*, which is formed around the peripheral surface of the stopper 23 at the upper portion of the stopper 23, receives a portion of the spring wire 24*a*, it is possible to prevent an axial elevation of the eccentric bush 12 including the stopper 23.

Figure 6:
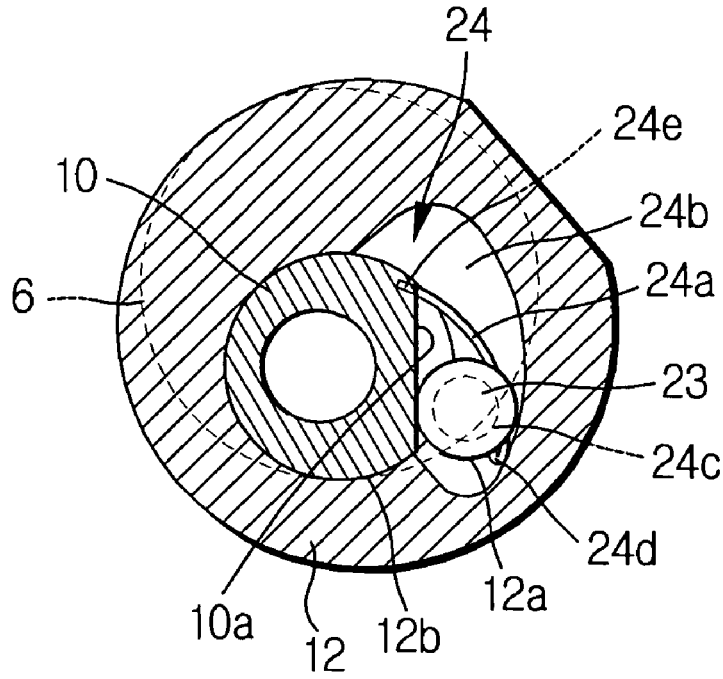
FIG. 6 is a cross-sectional view illustrating an eccentric coupling device according to another embodiment of the present invention.

FIG. 6 is a cross-sectional view illustrating an eccentric coupling device according to another embodiment of the present invention. The eccentric coupling device may be applied to the radial compliance scroll compressor shown in FIG. 1. In order to simplify the description thereof, the eccentric coupling device will be described in conjunction with the case in which it is applied to the radial compliance scroll compressor shown in FIG. 1. In FIG. 6, elements respectively corresponding to those in FIGS. 4 and 5 will be designated by the same reference numerals.

As shown in FIG. 6, the eccentric coupling device includes a crank pin 10 provided at an upper end of a crankshaft 6 such that it is eccentrically arranged with respect to the crankshaft 6, an eccentric bush 12 rotatably fitted around the crank pin 10, a stopper 23 fitted in the eccentric bush 12, and a backward rotation suppressing and recovering means 24 adapted to suppress a backward rotation of the eccentric bush 12, while elastically recovering the eccentric bush 12 when the backward rotation of the eccentric bush 12 has occurred.

The eccentric bush 12 is provided with a crank pin hole 12*b* extending vertically throughout the eccentric bush 12, and a stopper hole 12*a* extending vertically into the eccentric bush 12. The crank pin hole 12*b* receives the crank pin 10 such that the crank pin 10 is rotatable therein. The crank pin 10 is provided, at one side thereof, with a cutout formed at an upper portion of the crank pin 10 while having a D-shaped cross-section, and thus, a cut surface 10*a*.

The stopper 23 is fitted in the stopper hole 12*a*. The stopper hole 12*a* is arranged such that it overlaps with the crank pin hole 12*b*, so that the cylindrical stopper 23 fitted in the stopper hole 12*a* is radially protruded into the crank pin hole 12*b*. In accordance with this arrangement, the stopper 23 can come into contact with the cut surface 10*a* in accordance with rotation of the crank pin 10. Accordingly, rotation of the eccentric bush 12 is limited to a certain range.

The backward rotation suppressing and recovering means 24 comprises a spring wire 24*a* mounted, at one end thereof, to the crank pin 10, and adapted to elastically connect the stopper 23 to the crank pin 10, a spring contact recess 24*b* provided around the stopper hole 12*a* at an upper end of the stopper hole 12*a*, an engagement groove 24*c* formed around a peripheral surface of the stopper 23, a curling 24*d* formed at the other end of the spring wire 24*a*, and a spring mounting hole 24*e* provided at the crank pin 10 to receive the end of the spring wire 24*a* opposite to the curling 24*d*, thereby firmly mounting the spring wire 24*a*.

With this configuration, the backward rotation suppressing and recovering means 24 elastically connects the stopper 23 and crank pin 10, so that it not only suppresses the eccentric bush 12 carrying the stopper 23 from being backwardly rotated, but also recovers the eccentric bush 12 when the eccentric bush 12 has been backwardly rotated.

The spring wire 24*a* may be made of a steel wire having an elasticity. As described above, the spring wire 24*a* is mounted, at one end thereof, to the crank pin 10, while being engaged, at the other end thereof, with the peripheral surface of the stopper 23. Accordingly, when the eccentric bush 12 is backwardly rotated, the spring wire 24*a* is bent, so that it generates an elastic resilience. By virtue of this elastic resilience, it is possible not only to suppress the eccentric bush 12 carrying the stopper 23 from being backwardly rotated, but also to recover the eccentric bush 12 when the eccentric bush 12 has been backwardly rotated.

The spring contact recess 24*b* is in contact with the curling 24*d* of the spring wire 24*a* at a peripheral surface thereof. Accordingly, the spring wire 24*a* is bent when the eccentric bush 12 is rotated with respect to the crank pin 10, so that the elastic force of the spring wire 24*a* to support the eccentric bush 12 is increased. Also, a force to recover the eccentric bush 12 is increased. Thus, it is possible to more positively suppress a backward rotation of the eccentric bush 12, and to more positively recover the eccentric bush 12 from a backwardly rotated state thereof.

The engagement groove 24*c*, which is formed around the peripheral surface of the stopper 23, receives a portion of the spring wire 24*a* while allowing the spring wire 24*a* to be slidable therealong. Accordingly, the spring wire 24*a* can elastically support the stopper 23 while allowing the stopper 23 to be freely rotatable when the eccentric bush 12 rotates. Thus, when the eccentric bush 12 is backwardly rotated, the spring wire 24*a* is bent, so that it generates an elastic resilience.

The curling 24*d* is formed by bending the end of the spring wire 24*a* spaced away from the crank pin 10, so that it provides a round end surface. Accordingly, it is possible to minimize friction generated between the end of the spring wire 24*a* and the inner peripheral surface of the eccentric bush 12, thereby preventing the eccentric bush 12 from being damaged by the spring wire 24*a*.

The spring mounting hole 24*e* receives the end of the spring wire 24*a* opposite to the curling 24*d*, thereby firmly mounting the spring wire 24*a* to the crank pin 10. Thus, the spring wire 24*a* can be easily fixed to the crank pin 10.

Figure 7:
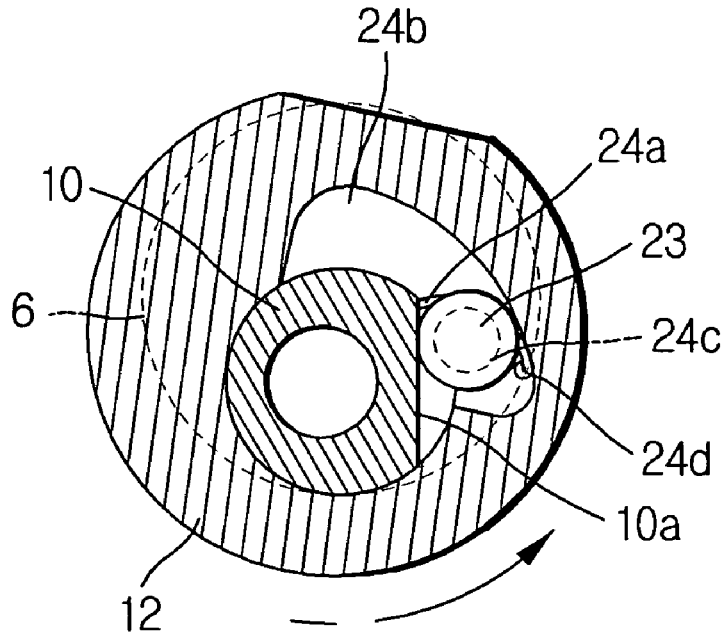
FIG. 7 is a cross-sectional view illustrating an operation of the eccentric coupling device shown in FIG. 6.

FIG. 7 is a cross-sectional view illustrating an operation of the eccentric coupling device shown in FIG. 6.

As shown in FIG. 7, at an initial stage of the scroll compressor, at which the orbiting scroll generates a centrifugal force smaller than the gas pressure in the compression chambers, the eccentric bush 12 is forced to be backwardly rotated from a normal position thereof, along with the stopper 23. At this time, the spring wire 24*a* is inwardly bent by the stopper 23 forced to be rotated, while being in contact with the inner peripheral surface of the spring wire 24*a*. As a result, the spring wire 24*a* generates an elastic resilience which is, in turn, applied to the eccentric bush 12 to forwardly rotate the eccentric bush 12.

The bending of the spring wire 24*a* is carried out as the other end of the spring wire 24*a* is pressed against the inner peripheral surface of the spring contact recess 24*b* in a state in which the spring wire 24*a* is slidably engaged with the engagement groove 24*c*. Although the other end of the spring wire 24*a* is pressed against the inner peripheral surface of the spring contact recess 24*b*, there is no damage to the spring contact recess 24*b* during the bending of the spring wire 24*a* because the curling 24*d* is formed at the other end of the spring wire 24*a*.

Thus, the eccentric bush 12 receives the elastic resilience of the spring wire 24*a*, simultaneously with the generation of the centrifugal force thereof. Accordingly, the force to recover the eccentric bush 12 from the rotated position to the normal position is increased, so that it is possible to rapidly recover the eccentric bush 12 to the normal position.

The rapid recovery of the eccentric bush 12 makes it possible to rapidly cut off leakage of refrigerant gas caused by rotation of the eccentric bush 12. As the leakage of refrigerant gas is rapidly cut off, it is possible to improve the compression efficiency and performance of the scroll compressor.

The spring wire 24*a* also serves to alleviate impact generated when the stopper 23 strikes the cut surface 10*a* as it is rotated along with the eccentric bush 12.

As apparent from the above description, the present invention provides an eccentric coupling device in a radial compliance scroll compressor, which is capable of applying an elastic force to an eccentric bush in one direction when the eccentric bush is rotated in the other direction due to a gas pressure in compression chambers greater than a centrifugal force of an orbiting scroll serving to perform an orbiting motion for compressing gas contained in the compression chambers, while preventing the eccentric bush from rising axially during the compression operation of the scroll compressor. In accordance with this eccentric coupling device, it is possible to reduce a time taken for the eccentric bush to return from a rotated position to a normal position, thereby rapidly cutting off leakage of refrigerant gas while preventing a tilting phenomenon caused by an axial elevation of the eccentric bush. Thus, it is possible to improve the compression efficiency and performance of the scroll compressor.

Such effects can be obtained, using a simple configuration only including a spring wire and a stopper. Accordingly, it is possible to achieve an improvement in workability and a reduction in manufacturing costs.

In accordance with the present invention, the spring wire, which is in contact with an inner peripheral surface of a spring contact recess formed at the eccentric bush to receive the spring wire, is provided with a curling at an end thereof contacting the inner peripheral surface of the spring contact recess. Accordingly, it is possible to minimize friction generated between the spring wire and the inner peripheral surface of the spring contact recess, and thus, to prevent a degradation in the performance of the scroll compressor caused by the friction.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An eccentric coupling device in a radial compliance scroll compressor, the eccentric coupling device comprising:

a crank pin eccentrically positioned at an upper end of a crankshaft included in the scroll compressor, and provided with a vertically-extending flat surface at one side of the crank pin;

a bush provided with a crank pin hole configured to receive the crank pin, and a stopper hole provided in the bush at one side of the crank pin hole such that the stopper hole overlaps with the crank pin hole;

a stopper fitted in the stopper hole such that the stopper radially protrudes into the crank pin hole toward the flat surface to selectively come into contact with the flat surface in accordance with a rotation of the bush; and an elevation preventer configured to elastically support the bush, while connecting the stopper and the crank pin via a spring wire, thereby preventing an elevation of the bush, one end of the spring wire being fixedly mounted to the crank pin, the spring wire being engaged with a peripheral surface of the stopper, the other end of the spring wire being movable, the spring wire elastically supporting the stopper.

2. The eccentric coupling device according to claim 1, wherein the bush further comprises:

a spring contact recess provided around the stopper hole at an upper end of the stopper hole such that the other end of the spring wire is in contact with an inner peripheral surface of the spring contact recess, wherein the spring wire is pressed against the inner peripheral surface of the spring contact recess when the bush is rotated, so that the spring wire is bent.

3. The eccentric coupling device according to claim 1, wherein the stopper further comprises:

an engagement groove provided around the peripheral surface of the stopper, and configured to receive a portion of the spring wire such that the spring wire is slidably engaged with the stopper.

4. The eccentric coupling device according to claim 1, wherein the elevation preventer further comprises:

a curling provided at the other end of the spring wire, the curling being provided by a bend of the other end of the spring wire.

5. The eccentric coupling device according to claim 1, wherein the crank pin further comprises:

a spring mounting hole provided at the crank pin, and configured to receive the one end of the spring wire, thereby firmly mounting the spring wire.

6. An eccentric coupling device in a radial compliance scroll compressor, the eccentric coupling device comprising:

a crank pin eccentrically positioned at an upper end of a crankshaft included in the scroll compressor, and provided with a vertically-extending flat surface at one side of the crank pin;

a bush provided with a crank pin hole configured to receive the crank pin, and a stopper hole provided in the bush at one side of the crank pin hole such that the stopper hole overlaps with the crank pin hole;

a stopper fitted in the stopper hole such that the stopper radially protrudes into the crank pin hole toward the fiat surface to selectively come into contact with the flat surface in accordance with a rotation of the bush; and a backward rotation suppressing and recovering device configured to suppress a backward rotation of the bush, while connecting the stopper and the crank pin via a spring wire, thereby elastically recovering the bush when the backward rotation of the bush has occurred, one end of the spring wire being fixedly mounted to the crank pin, the spring wire being engaged with a peripheral surface of the stopper, the other end of the spring wire being movable, the spring wire elastically supporting the stopper.

7. The eccentric coupling device according to claim 6, wherein the bush further comprises:

a spring contact recess provided around the stopper hole at an upper end of the stopper hole such that the other end of the spring wire is in contact with an inner peripheral surface of the spring contact recess, wherein the spring wire is pressed against the inner peripheral surface of the spring contact recess when the bush is rotated, so that the spring wire is bent.

8. The eccentric coupling device according to claim 6, wherein the stopper further comprises:

an engagement groove provided around the peripheral surface of the stopper, and configured to receive a portion of the spring wire such that the spring wire is slidably engaged with the stopper.

9. The eccentric coupling device according to claim 6, wherein the backward rotation suppressing and recovering device further comprises:

a curling provided at the other end of the spring wire, the curling being provided by a bend of the other end of the spring wire.

10. The eccentric coupling device according to claim 6, wherein the crank pin further comprises:

a spring mounting hole provided at the crank pin, and configured to receive the one end of the spring wire, thereby firmly mounting the spring wire.

11. An eccentric coupling device for use in a radial compliance scroll compressor, the eccentric coupling device comprising:

a crank pin eccentrically positioned at an upper end of a crank shaft included in the scroll compressor and provided with a vertically extending flat surface at one side of the crank pin;

a bush provided with a crank pin hole configured to receive the crank pin, and a stopper hole provided in the bush at one side of the crank pin hole such that the stopper hole overlaps with the crank pin hole;

a stopper fitted in the stopper hole such that the stopper radially protrudes into the crank pin hole towards the flat surface to selectively come in contact with the flat surface in accordance with a rotation of the bush;

an elevation preventer configured to elastically support the bush, while connecting the stopper and the crank pin via a spring wire, thereby preventing an elevation of the bush, one end of the spring wire being fixedly mounted to the crank pin wall, the spring wire being engaged with a peripheral surface of the stopper, the spring wire elastically supporting the stopper; and the bush comprising a spring contact recess provided around the stopper hole at an upper end of the stopper hole such that the other end of the spring wire is in contact with a peripheral surface of the spring contact recess;

wherein the spring wire is pressed against the peripheral surface of the spring contact recess when the bush is rotated, so that the spring wire is bent.

* * * * *